US011440624B2

(12) United States Patent
Goslinga et al.

(10) Patent No.: US 11,440,624 B2
(45) Date of Patent: Sep. 13, 2022

(54) VESSEL FOR TOWING ANOTHER VESSEL

(71) Applicant: DAMEN 40 B.V., Gorinchem (NL)

(72) Inventors: Ernst Jan Goslinga, Brielle (NL); Robbert Marinus Haverkamp, Sleeuwijk (NL); Tim Van Den Heuvel, Utrecht (NL); Robert Michiel Van Koperen, Voorburg (NL)

(73) Assignee: DAMEN 40 B.V., Gorinchem (NL)

( * ) Notice: Subject to any disclaimer, the term of this patent is extended or adjusted under 35 U.S.C. 154(b) by 105 days.

(21) Appl. No.: 16/969,408

(22) PCT Filed: Feb. 15, 2019

(86) PCT No.: PCT/EP2019/053837
§ 371 (c)(1),
(2) Date: Aug. 12, 2020

(87) PCT Pub. No.: WO2019/158702
PCT Pub. Date: Aug. 22, 2019

(65) Prior Publication Data

US 2020/0398942 A1 Dec. 24, 2020

(30) Foreign Application Priority Data

Feb. 15, 2018 (EP) ..... 18156858

(51) Int. Cl.
*B63B 21/58* (2006.01)
*B63B 35/68* (2006.01)

(52) U.S. Cl.
CPC ..... *B63B 21/58* (2013.01); *B63B 35/68* (2013.01)

(58) Field of Classification Search
CPC ... B63B 21/56; B63B 2021/566; B63B 21/58; B63B 21/60

(Continued)

(56) References Cited

U.S. PATENT DOCUMENTS 86,737 A * 2/1869 De Mesnil et al. .... B63B 21/56 440/34
124,326 A * 3/1872 Buchanan ..... B63B 21/56 440/34
2006/0102060 A1 5/2006 Vila Boixadera et al.

FOREIGN PATENT DOCUMENTS

EP 1535831 A1 6/2005
NL 1010650 C1 5/2000

OTHER PUBLICATIONS

International Search Report dated Mar. 6, 2019, for corresponding International Patent Application No. PCT/EP2019/053837, filed Feb. 15, 2019.

(Continued)

*Primary Examiner* — Daniel V Venne
(74) *Attorney, Agent, or Firm* — Steven M. Koehler; Westran, Champlin & Koehler, P.A.

(57) ABSTRACT

A vessel for towing another vessel comprises a hull, a tow cable coupled to the hull, a hook having a first leg fixed to a free end of the cable, a second leg including a free end and a hook bottom. The first and second legs form an opening for receiving a rope located at the vessel and launched from another vessel. The first and second legs extend in a main plane. A rope positioning system positions a rope and a hook support for the hook with respect to each other such that the rope extends in transverse direction of the main plane at the opening of the hook when the hook is linked to the hook support. A rope pressing system presses the rope the hook towards the hook bottom when the hook is linked to the hook support, creating a clamping force between the legs and the rope.

20 Claims, 6 Drawing Sheets

(58) Field of Classification Search
USPC ..... 114/242, 249, 253
See application file for complete search history.

(56) References Cited

OTHER PUBLICATIONS

Written Opinion of the International Searching Authority dated Mar. 6, 2019, for corresponding international Patent Application No. PCT/EP2019/053837, filed Feb. 15, 2019.

* cited by examiner

VESSEL FOR TOWING ANOTHER VESSEL

CROSS-REFERENCE TO RELATED APPLICATION

The present application is a national stage of and claims priority of International patent application Serial No. PCT/EP2019/053837, filed Feb. 15, 2019, and published in English as WO 2019/158702.

BACKGROUND

Aspects of the present invention relate to a vessel for towing another vessel.

SUMMARY

An aspect of the disclosure provides a vessel which has a simple and robust system for fastening a tow cable of the vessel to a tow rope of a vessel to be towed.

The vessel comprises a hull, a tow cable which is coupled to the hull, a V-shaped hook having a first leg which is fixed to a free end of the tow cable, a second leg including a free end and a hook bottom where the first leg meets the second leg at a distance from the free end of the second leg, hence forming an opening between the legs at the free end of the second leg for receiving a tow rope that is located at the vessel and launched from another vessel, wherein the first and second legs extend in a main plane, and wherein the vessel further comprises a hook support to which the hook is linkable, a rope positioning system for positioning a tow rope and the hook support with respect to each other such that the tow rope extends in transverse direction of the main plane at the opening of the hook when the hook is linked to the hook support, and a rope pressing system for pressing a tow rope positioned at the opening of the hook towards the hook bottom when the hook is linked to the hook support, hence creating a clamping force between the legs and the tow rope under operating conditions.

The vessel may be a tugboat which receives a tow rope that is launched from a vessel to be towed. The rope positioning system is able to bring the tow rope and the hook in a mutual position such that the tow rope is located at the opening of the hook and the rope pressing system can press the rope between the legs of the hook. After pressing the tow rope between the legs, the tow rope is sufficiently fixed to the hook by the clamping force between the legs and the tow rope such that the hook can be released from the hook support without keeping a pressing force on the rope by the pressing system. The hook including the tow cable can be simply pulled upwardly by pulling the clamped tow rope by the vessel to be towed.

The clamping force may be caused by elastic properties of at least one of the tow rope and the hook. In practice the tow rope can be made of relatively thin braided rope which may be more flexible than the hook. Usually, the tow rope is only used for pulling the tow cable of the tugboat towards the vessel to be towed where the tow cable is fixed to a haul point, for example, such that the tow rope itself is not used during towing.

It is noted that the tow cable may be coupled to the hull through a winch.

In a particular embodiment, the hook support has a carrier, wherein when the hook is linked to the hook support the hook is supported by the hook support via its first leg and moveable with respect to the carrier in longitudinal direction of the first leg between a rope receiving position for receiving a tow rope at the opening and a rope clamping position for clamping a tow rope between the legs, wherein the rope pressing system comprises a pressing member which has a fixed position at the carrier and a driving mechanism for moving the hook from its rope receiving position to its rope clamping position during which the hook bottom moves towards the pressing member. This means that the pressing member may stay at the vessel when the hook including the tow cable are pulled upwardly by the vessel to be towed.

In a more particular embodiment the rope positioning system is formed by the carrier which is movable with respect to the hull in a direction parallel to the main plane and transversely to the first leg when the hook is linked to the hook support. This provides the opportunity to move the hook support with respect to the hull until the hook contacts the tow rope and the tow rope tends to bend about the first leg of the hook. In this condition the tow rope may automatically extend in transverse direction of the main plane of the hook at the opening of the hook.

The pressing member may be located next to the hook at the opening in transverse direction of the main plane when the hook is linked to the hook support. In this case the pressing member pulls the tow rope between the legs of the hook.

In order to create a pulling force at both sides of the main plane the pressing member may be located at opposite sides of the hook at the opening in transverse direction of the main plane when the hook is linked to the hook support.

In a practical embodiment the carrier has a tow rope receiving surface including a slot for receiving at least a part of the second leg upon moving the hook from its rope receiving position to its rope clamping position, wherein at least one of the edges of the slot forms the pressing member, and wherein in the rope receiving position the free end of the second leg is remote from the tow rope receiving surface. Before a clamping action is started a tow rope of a vessel to be towed can be positioned on the tow rope receiving surface such that the tow rope extends transversely to the slot on the slot. In this case the edges of the slot create a pulling force on the tow rope when moving the second leg into the slot. In the rope receiving position the tow rope can slide between the free end of the second leg and the tow rope receiving surface to the opening of the hook.

The free end of the second leg may be directed downwardly when the hook is in the rope receiving position. This means that the hook is moved downwardly from the rope receiving position to the rope clamping position in which the tow rope is clamped between the legs of the hook. The tow rope receiving surface may be a horizontal upper surface of the carrier.

In an advantageous embodiment the hook support is provided with a tow cable catcher for catching and guiding the tow cable when the hook is at a distance from the hook support and drawn by the tow cable towards the hook support, which tow cable catcher is mounted to the carrier and movable with respect thereto in the same direction as the hook between a catching position in which it projects from the rope receiving surface and a guiding position in which it is located beyond the hook as seen in a direction along the first leg from the hook to the tow cable when the hook is in its rope receiving position, such that in the rope receiving position the tow cable extends successively in one direction from the first leg of the hook to the tow cable catcher and via the tow cable catcher in opposite direction.

The tow cable catcher may comprise a T-shaped element. On the one hand, each of the lateral parts of the T-shaped element can be used for guiding the tow cable when the cable catcher guides the tow cable as described above. On the other hand, each of the lateral parts can function as a catching hook when the T-shaped element projects from the tow rope receiving surface. The catching hook can be moved with respect to the hull by moving the carrier. This provides the opportunity of contacting and catching the tow cable when this is launched from the towed vessel after a towing operation. After catching the tow cable the tow cable catcher can also be moved with respect to the carrier to its guiding position whereas the tow cable can be drawn, for example by a towing winch, in order to pull the hook towards the hook support.

In a practical embodiment the hook support is provided with a tube in which a portion of the first leg fits against an abutment and in which the tow cable catcher fits, wherein the first leg and the tow cable catcher are movable with respect to the tube in longitudinal direction thereof, wherein the tube is mounted to the carrier and movable with respect to the carrier in a direction parallel to the first leg, wherein the tube is lockable with respect to the carrier and the tow cable catcher is lockable with respect to the tube. In the rope receiving position the free end of the second leg may lie at a distance from the tube as seen along the tube. When the hook must be moved from its rope receiving position towards its rope clamping position the tube and the hook must be moved together with respect to the carrier during which the tow cable catcher may be locked with respect to the tube. When the hook is moved in opposite direction from its rope clamping position the tube can be locked with respect to the carrier and the tow cable catcher can be de-locked with respect to the tube such that upon pulling the clamped tow rope the hook moves out of the tube and may take the tow cable catcher to a position where the T-shaped element projects from the tow rope receiving surface of the carrier such that the tow cable can be released from the cable catcher.

After finalizing a towing operation the tow cable including the hook is dropped by the towed vessel and can be drawn back. The T-shaped element can be positioned in its catching position and the tube can be positioned to a location in which the T-shaped element also projects from the tube. When the tube is locked in this position and the T-shaped element catches the tow cable the T-shaped element can be moved into the tube. It can be locked with respect to the tube in its guiding position and the hook can be moved towards the tube by drawing the tow cable, for example by a towing winch. During the latter operation the T-shaped element guides the tow cable.

The lateral parts of the T-shaped element preferably fit inside the tube such that the tow cable cannot escape between the lateral parts and the tube when the T-shaped element is in its guiding position.

The hook support and the first leg may be adapted such that the hook has a final number of discrete positions in rotational direction about the first leg in its rope receiving position. This provides one or more predefined orientations of the hook with respect to the hook support.

In a specific embodiment one of the first leg and the hook support has a protrusion and the other one of the first leg and the hook support has a guiding surface for guiding the protrusion upon linking the first leg to the hook support. This is a simple structure for bringing the hook in a desired orientation with respect to the hook support.

At least one of the first leg and the second leg may have a decreasing thickness in transverse direction of the main plane as seen in a direction towards each other. This provides an appropriate clamping force on a tow rope.

The distance between the first leg and the second leg may decrease progressively in a direction from the opening to the hook bottom, for example substantially exponentially, which results in reliable clamping performance of the tow rope.

At least a portion of the tow cable may be resilient, for example a portion at or close to the hook. Such a resilient portion of the tow cable may have a lower elastic modulus than the remainder of the tow cable. This avoids excessive forces between the hook member and the hook support upon linking the hook to the hook support. This might typically occur in case the tow cable is drawn by a heavy-duty towing winch which may not stop immediately upon switching it off.

BRIEF DESCRIPTION OF THE DRAWINGS

Aspects of the invention will hereafter be elucidated with reference to very schematic drawings showing an embodiment of the invention by way of example.

DETAILED DESCRIPTION

Figure 1:
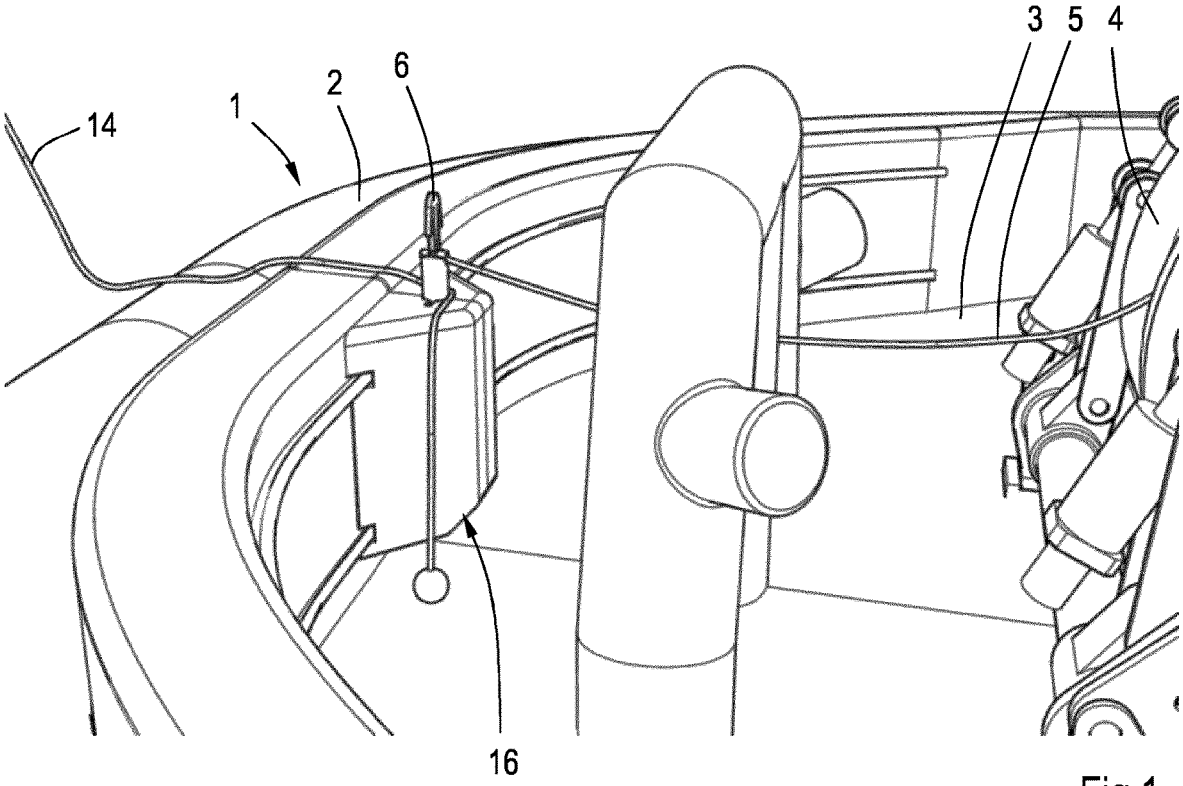
FIG. 1 is a perspective view of a part of an embodiment of a vessel.

FIG. 1 shows a part of an embodiment of a vessel in the form of a tugboat 1. The tugboat 1 has a hull including a gunwale 2 and a deck 3. A towing winch 4 onto which a tow cable 5 is coiled is mounted on the deck 3. The tow cable 5 has a free end to which a hook member 6 is fixed, see FIG. 9.

Figure 4:
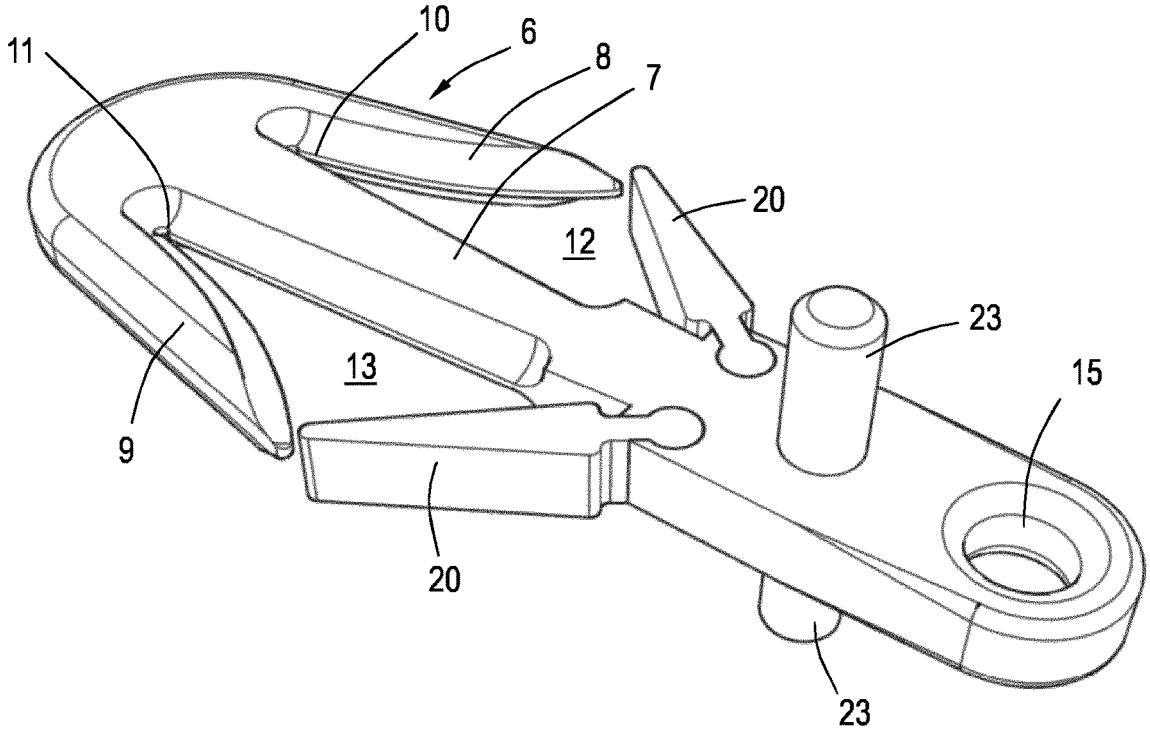
FIG. 4 is a perspective view of a part of the vessel of FIG. 1 on a larger scale, showing a hook member.

FIG. 4 shows the hook member 6 as a separate part. The hook member 6 is provided with a first leg 7, a second leg 8 and a third leg 9, which legs 7-8 lie within a common main plane. The first leg 7 and the second leg 8 form a first V-shaped hook, whereas the first leg 7 and the third leg 9 form a second V-shaped hook. The hooks have respective hook bottoms 10, 11 where the first leg 7 meets the second leg 8 and the third leg 9, respectively. The second and third legs 8, 9 have respective free ends remote from the respective hook bottoms 10, 11. At the free ends of the second and third legs 8, 9 the hooks form respective openings 12, 13 between the first and second legs 7, 8 and between the first and third legs 7, 9. The openings 12, 13 are wide enough to receive a tow rope 14 that is launched from another vessel (not shown). In the situation as shown in FIG. 1 the tow rope 14 is supported by the gunwale 2 and its free end to which a weight is attached, lies on the deck 3. The weight may be a separate weight, but it may also be integrated in the tow rope 14, for example by a plurality of knots of an end portion of the tow rope 14. The tow rope 14 can be received by one of the openings 12, 13 and clamped between the first and second legs 7, 8 or the first and third legs 7, 9.

Figure 3:
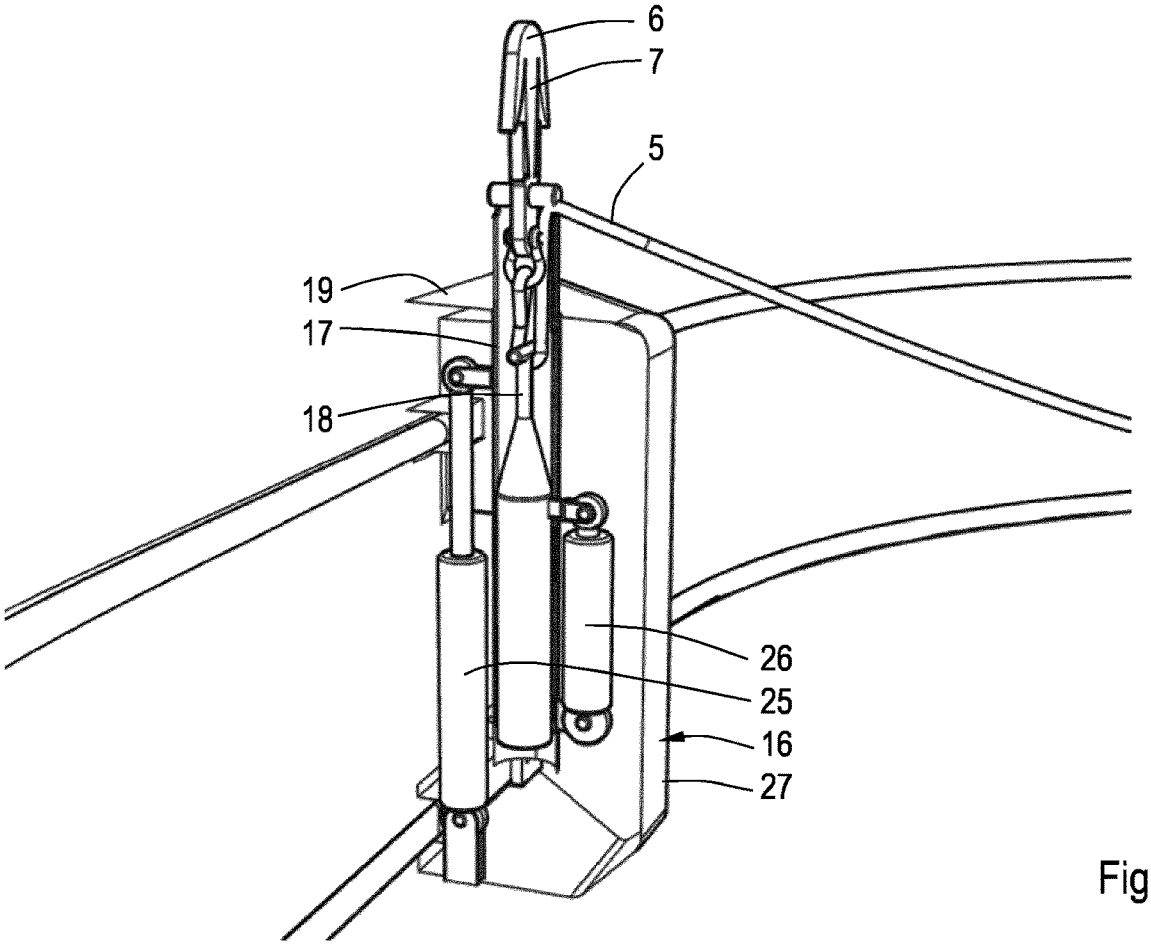
FIG. 3 is a perspective cut-away view of the part of FIG. 2 as seen from a different side.

The first leg 7 of the hook member 6 has a through-hole 15 through which a shackle of the tow cable 5 passes, see FIG. 3. In the embodiment as shown in FIG. 4 the hook member 6 is made of a substantially rigid plastic. The hook member 6 may have elastic properties since it may be coiled on a winch on the vessel to be towed, together with the tow cable 5. For similar reasons the hook member 6 is preferably relatively small, for example it has a maximum length of 30 cm and a maximum width of 15 cm. The distance between the first leg 7 and the second leg 8 and the distance between the first leg 7 and the third leg 9 decreases substantially exponentially in a direction from the respective openings 12, 13 to the respective hook bottoms 10, 11. Consequently, a wide range of tow rope thicknesses can be received and clamped by the hook member 6. Furthermore, the thicknesses of the legs 7, 8, 9 decrease in a direction towards each other. This means that a flexible tow rope 14 will be deformed locally upon moving from one of the openings 12, 13 towards the corresponding hook bottom 10, 11, causing a proper attachment of the tow rope 14 to the hook member 6.

Figure 2:
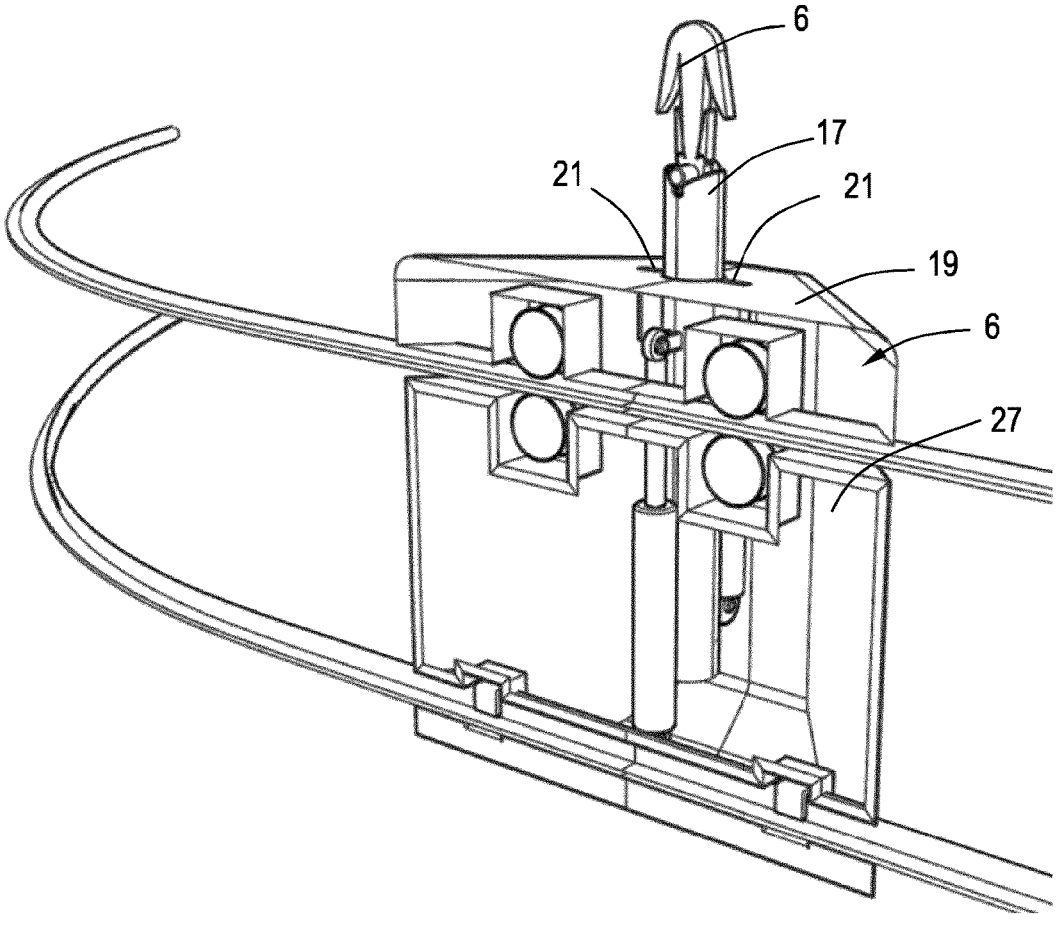
FIG. 2 is a perspective view of a part of the vessel of FIG. 1 on a larger scale.

The hook member 6 is linkable to a hook support 16 such that it is supported by the hook support 16. The hook support 16 comprises a carrier 27 which is movable on two parallel rails along the gunwale 2. The hook support as shown in the figures comprises an upwardly directed tube 17 in which a portion of the first leg 7 of the hook member 6 fits against an abutment. The tube 17 is mounted to the carrier 27 and moveable with respect thereto in longitudinal direction of the first leg 7. FIGS. 1-3 show the hook member 6 in a rope receiving position with respect to the hook support 16. In this condition the hook member 6 is temporarily linked to the hook support 16 such that it has a fixed position with respect to the hook support 16. The fixed position is selected such that when moving the hook support 16 along the gunwale 2 the hook member 6 moves in a direction which has a component parallel to the main plane of the hook member 6. Consequently, the tube 17 and the tow rope 14 will meet each other as illustrated in FIG. 1. The hook member 6 can be moved from the rope receiving position as shown in FIG. 1 downwardly to a rope clamping position in which the tow rope 14 is clamped in one of the two hooks of the hook member 6 by moving the tube 17 downwardly with respect to the carrier 27. At a certain moment during the movement of the hook member 6 and the tube 17 the tow rope 14 will extend in transverse direction of the main plane at one of the openings 12, 13 before it is clamped by the hook member 6. Hence, the hook support 16 and the first leg 7 of the hook member 6 form part of a rope positioning system for properly positioning the tow rope 14 and the hook member 6 with respect to each other. The hook member 6 is also movable with respect to the tube 17 in order to remove the hook member 6 from the tube 17, together with the tow rope 14 and the tow cable 5.

Figure 9:
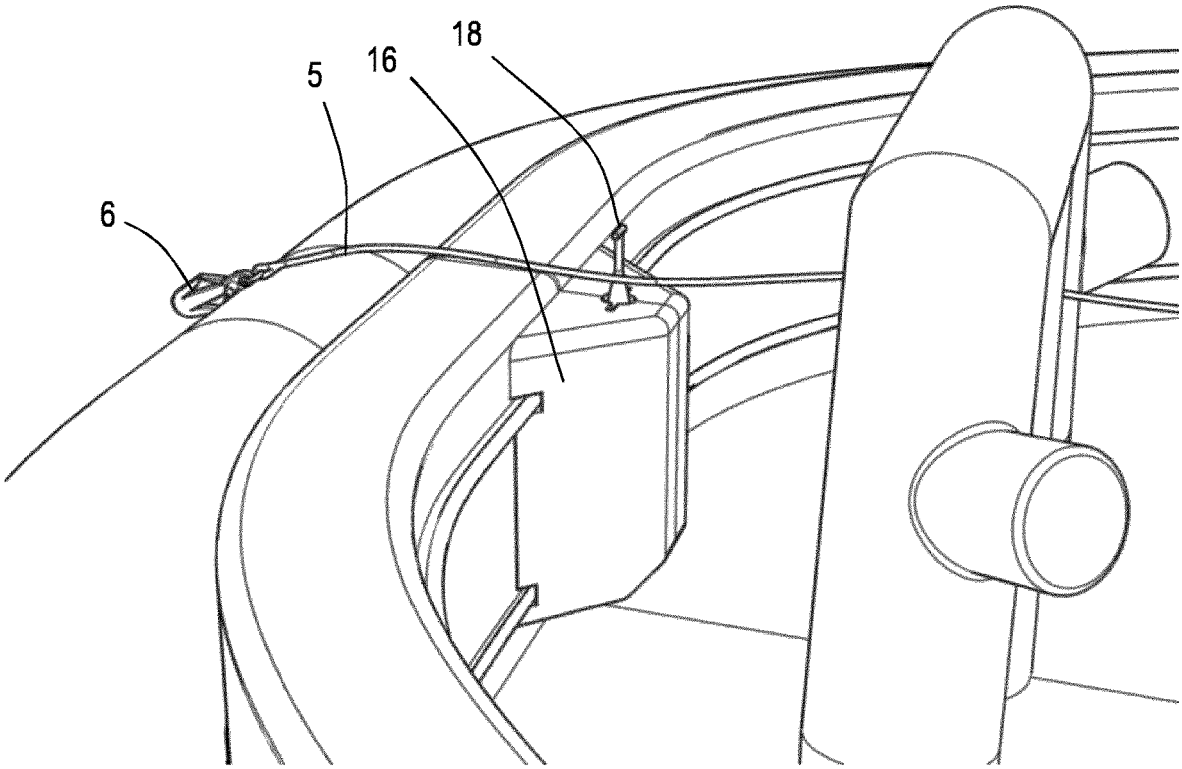

FIG. 3 shows the tube 17 in a cut-away view. The tube 17 is provided with a T-shaped tow cable catcher 18 for guiding the tow cable 5 when the hook member 6 is located outside the tube 17. This situation happens when a towed vessel is decoupled from the tugboat 1 and the hook member 6 is thrown downwardly from the towed vessel and retrieved by the tugboat 1. Since the tow cable catcher 18 is movable in longitudinal direction of the tube 17 the tow cable catcher 18 can be positioned above the tube 17 and above an upper surface 19 of the carrier 27 which surrounds the tube 17. This is illustrated in FIG. 9. In this condition the hook support 16 can be moved along the gunwale 2 until the tow cable catcher 18 contacts the tow cable 5, after which the tow cable catcher 18 can be lowered back into the tube 17 whereas the tow cable 5 is taken downwardly, as well. Subsequently, the tow cable catcher 18 can be hold at a fixed position with respect to the tube 17 such that the tow cable catcher 18 becomes a guide for guiding the tow cable 5 when the towing winch 4 draws the tow cable 5 in order to bring the hook member 6 back into the rope receiving position as shown in FIG. 1. In the rope receiving position the hook member 6 is located above the tow cable catcher 18 and the tow cable 5 extends successively from the first leg 7 downwardly via the tow cable catcher 18 and upwardly therefrom to an upper end of the tube 17 and then to the towing winch 4, see FIG. 3.

The tube 17 and the first leg 7 are adapted such that the hook member 6 has two discrete positions with respect to the tube 17 in rotational direction about the first leg 7 in its rope receiving position. Hence, the upper end of the tube 17 is able to bring the hook member 6 in a predetermined orientation upon moving it into the tube 17.

The tube 17 is displaceable in vertical direction with respect to the carrier 27 by a first hydraulic cylinder 25 between an upper position in which the hook member 6 is in the rope receiving position and the tube 17 projects upwardly from the upper surface 19 and a lower position in which the hook member 6 is in the rope clamping position and the upper end of the tube 17 is located below the upper surface 19. It is also conceivable that the upper end of the tube 17 is located at substantially the same level as the upper surface 19.

The tow cable catcher 18 is displaceable with respect to the tube 17 in vertical direction of the tube 17 by a second hydraulic cylinder 26. In the situation as shown in FIG. 3 the second hydraulic cylinder 26 is in a retracted condition. When the tube 17 is in its lower position the second hydraulic cylinder 26 may be operated such that the tow cable catcher 18 is moved upwardly with respect to the tube 17 and may project upwardly from the upper surface 19 whereas the upper end of the tube 17 remains at or below the upper surface 19.

Figure 12:
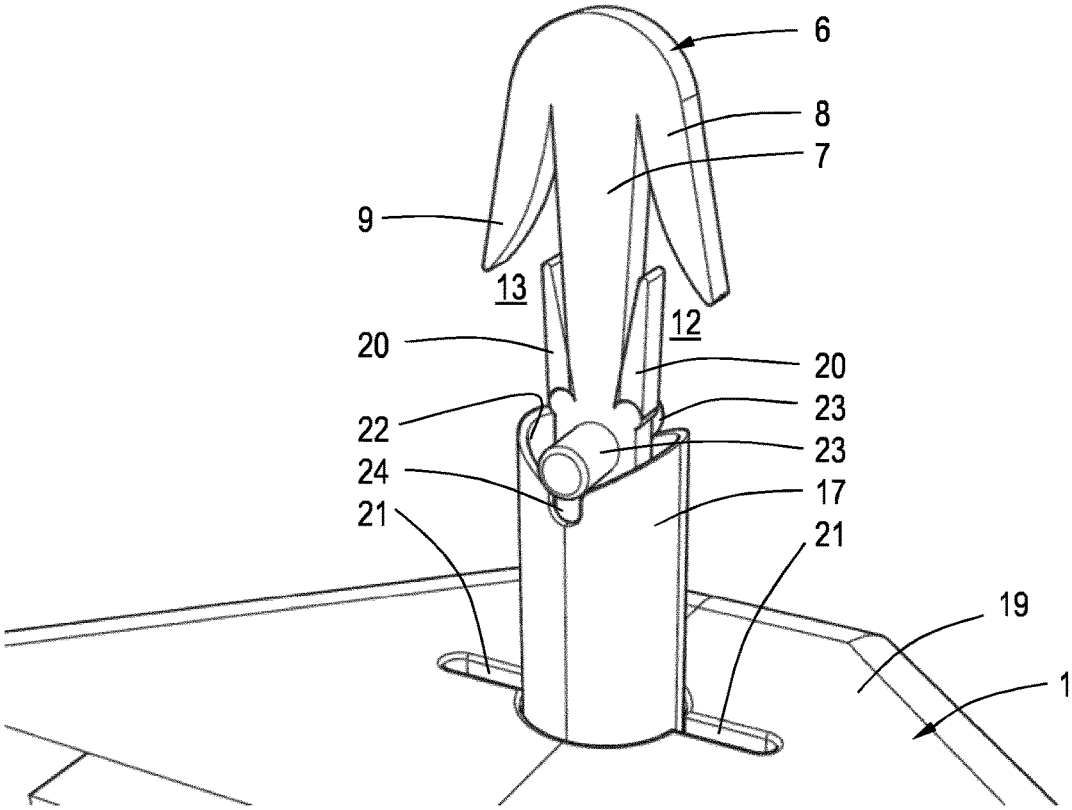
FIG. 12 is a similar view as FIG. 2, showing a part thereof on a large scale.

FIG. 4 shows that the first leg 7 of the hook member 6 is provided with flexible rods 20 extending in the main plane in outward direction from the first leg 7 as seen from the through-hole 15 towards the hook bottoms 10, 11. The flexible rods 20 have free ends which end at or close to the free ends of the second and third legs 8, 9 of the hook member 6 in a rest condition of the flexible rods 20. The flexible rods 20 can be moved towards the first leg 7 of the hook member 6 upon inserting the first leg 7 into the tube 17 such that they do not obstruct the openings 12, 13 in the rope receiving position of the hook member 6. This is illustrated in FIG. 12. After the hook member 6 is fixed to the tow rope 14 and leaves the tube 17 the flexible rods 20 return to their spread rest positions. When the hook member 6 is returned to the tugboat the risk of getting caught on any obstacle by the second and third legs 8, 9 is minimized due to the presence of the spread flexible rods 20.

Figure 6:
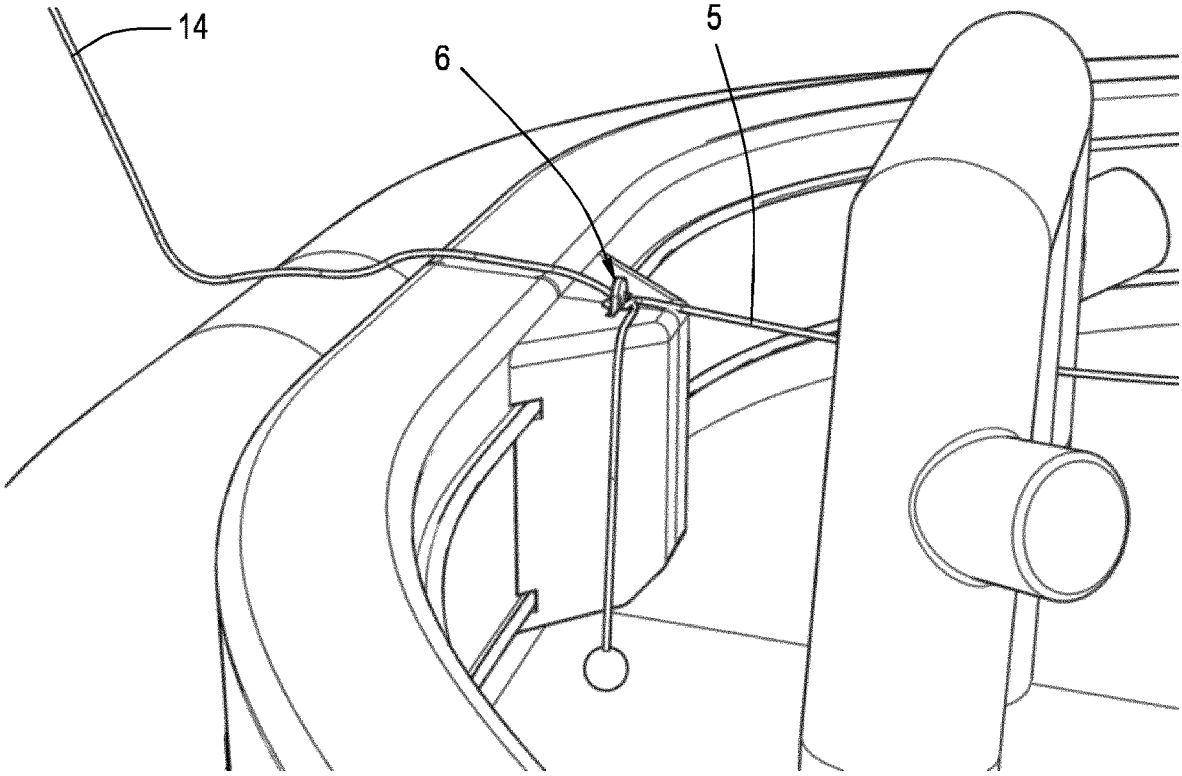

In order to fix the tow rope 14 to the hook member 6 the hook member 6 has temporarily a fixed position with respect to the tube 17, after which the tube 17 including the hook member 6 is moved downwardly with respect to the upper surface 19 from the rope receiving position downwardly by the first hydraulic cylinder 25, but alternative driving mechanisms are conceivable. The upper surface 19 is provided with two slots 21 which extend at opposite sides of the tube 17 in the main plane of the hook member 6 when this is in the rope receiving position. The second and third legs 8, 9 of the hook member 6 fit in the respective slots 21. Hence, when the tow rope 14 is located at the opening 12 and the hook member 6 is moved downwardly the tow rope 14 is pressed towards the hook bottom 10 by opposite edges of one of the slots 21 by moving the tube 17 including the hook member 6 downwardly with respect to the carrier 27. This is illustrated in FIG. 6, where the second and third legs 8, 9 are partly received by the cooperating slots 21. During the movement in downward direction the position of the hook member 6 with respect to the tube 17 is maintained, for example by pulling the tow cable 5, possibly by means of the towing winch 4. In fact the edges of each slot 21 form a pressing member for pressing the tow rope 14 towards the hook bottom 10. Due to the shape of the legs 7-9 of the hook member 6 a clamping force between the legs 7-9 and the tow rope 14 is created.

Figure 7:
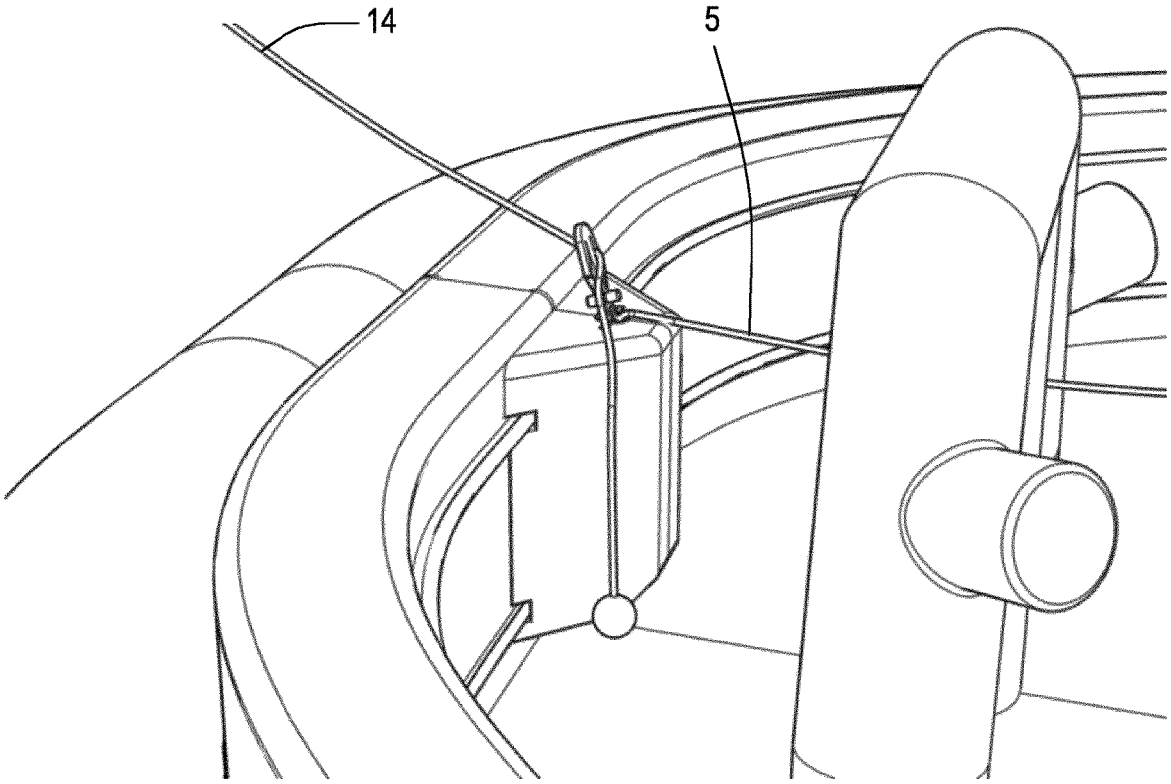
Figure 8:
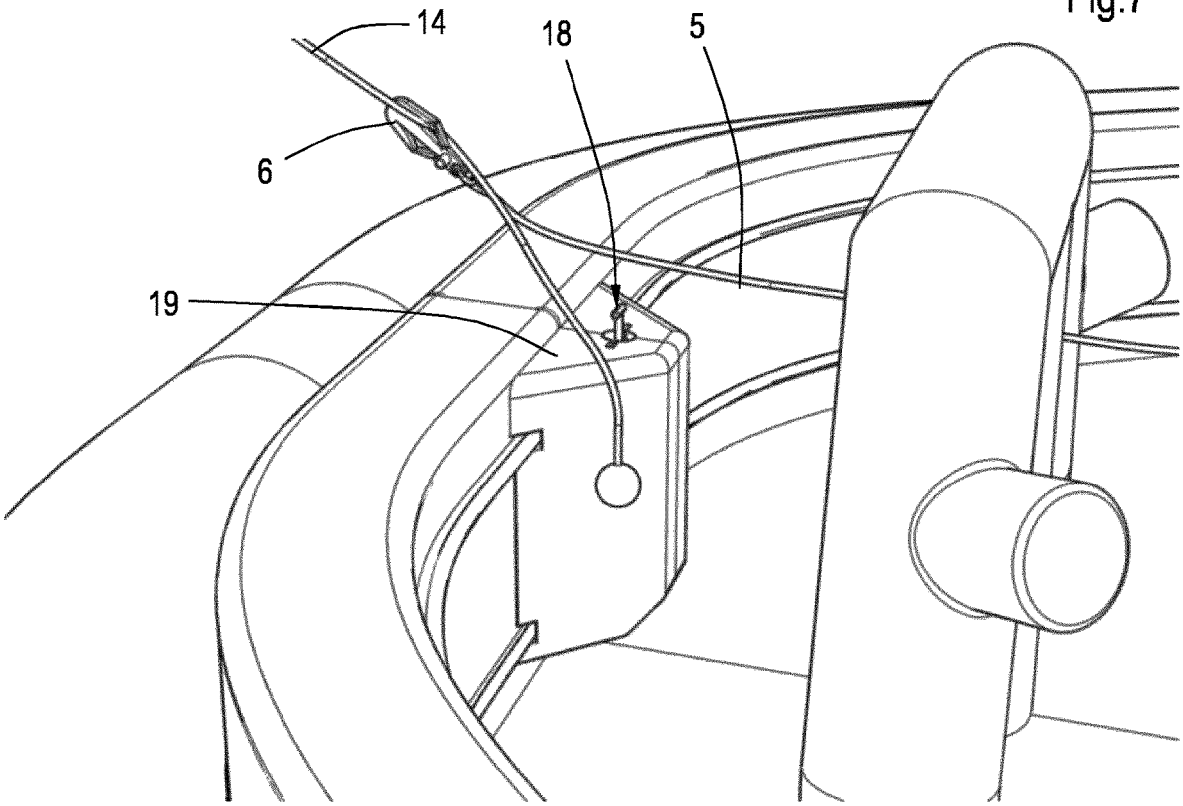

FIG. 7 shows a next step in which the tow rope 14 is pulled upwardly by the vessel to be towed such that the hook member 6 leaves the tube 17. The cable catcher 18 may then be moved upwardly simultaneously to a position above the upper surface 19 whereas the tube 17 is maintained at a fixed position with respect to the carrier 27. The cable catcher 18 may be lifted automatically up to a stop position by the pulling force of the tow cable 5 or driven upwardly by the second hydraulic cylinder 26. The tow cable 5 will leave the cable catcher 18 whereas the hook member 6 and the tow cable 5 will be drawn to the vessel to be towed. The latter condition is illustrated in FIG. 8.

Figure 5:
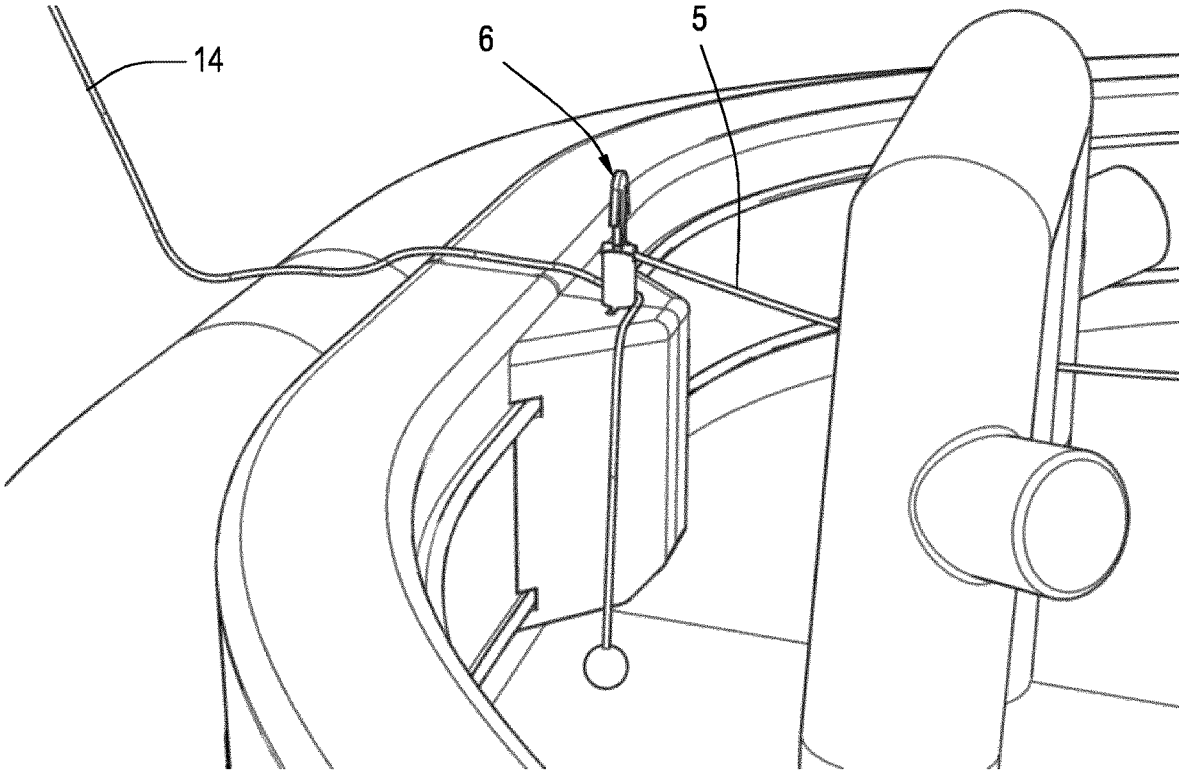
FIGS. 5-11 are similar views as FIG. 1, showing successive steps of fastening a tow cable and a tow rope to each other.
Figure 10:
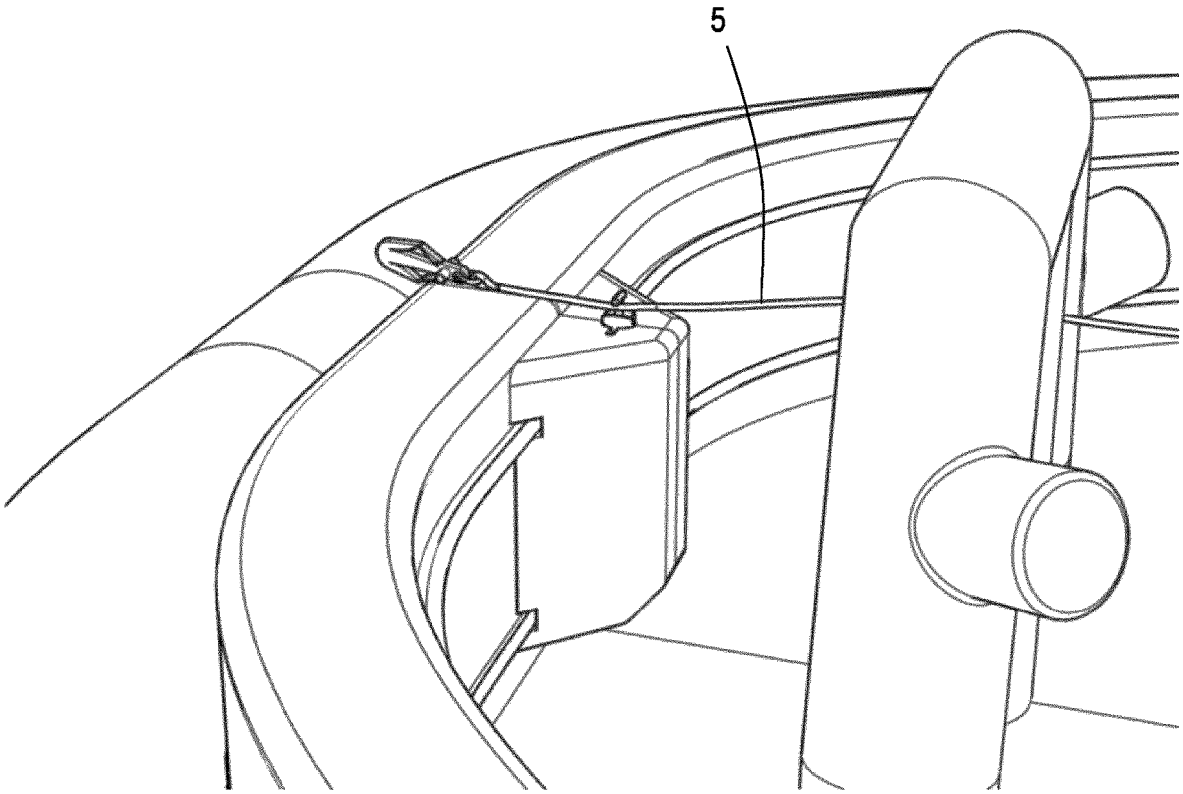
Figure 11:
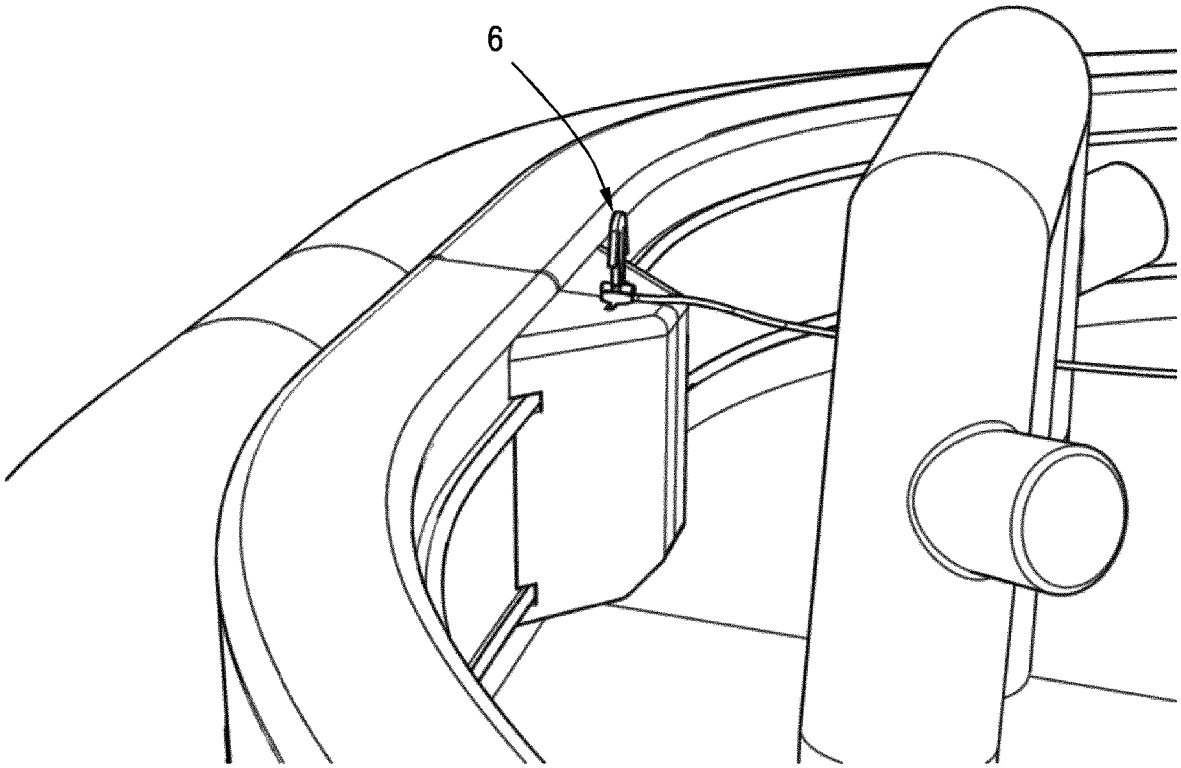

After the towing operation is finished the vessel which was towed will detach the tow cable 5 including the hook member 6 and launch it back to the tugboat 1. The towing winch 4 will draw the tow cable 5 until it is located at the gunwale 2 as illustrated in FIG. 9. The cable catcher 18 can be moved upwardly with respect to the tube 17 and the carrier 27 can be moved along the gunwale 2 until the cable catcher 18 contacts the tow cable 5. Subsequently, the T-shaped cable catcher 18 is moved downwardly with respect to the tube 17 as illustrated in FIG. 10. The tow cable 5 is drawn further by the towing winch 4 until the first leg 7 of the hook member 6 enters the tube 17. This condition is shown in FIG. 11. Before a next towing operation the hook member 6, the tube 17 and the cable catcher 18 can be moved upwardly together to the rope receiving condition of the hook member as shown in FIG. 5.

The upper end of the tube 17 and the hook member 6 are shaped such that the hook member 6 is forced in a predefined rotational position with respect to the tube 17 when entering the tube 17. FIG. 12 shows that in this embodiment the upper end of the tube 17 has two opposite recesses 22. At both sides of each recess the upper end of the tube 17 gradually increases to a top. Furthermore, the first leg 7 is provided with two pins 23 which project in opposite directions perpendicularly with respect to the main plane of the hook member 6. The distance between opposite ends of the pins 23 is larger than the internal diameter of the tube 17. Consequently, when the first leg 7 of the hook member 6 enters the tube 17 the upper end thereof will guide the hook member 6 to a position in which the pins 23 are received by the recesses 22. At least the recess 22 which is located closest to the towing winch 4 has such a shape that when the pins 23 are received by the recesses 22, as shown in FIG. 12, there is still a trough-hole 24 between the pin 23 and the tube 17 in order to provide a passage for the tow cable 5, see FIGS. 3 and 12.

The exterior side of the carrier 27 is provided with curved edges in order to facilitate guidance of the tow rope 14 and the tow cable 5 towards the hook member 6 and the cable catcher 18, respectively, upon moving the carrier 27 along the gunwale 2.

The invention is not limited to the embodiment shown in the drawings and described hereinbefore, which may be varied in different manners within the scope of the claims and their technical equivalents. For example, the hydraulic cylinders may be replaced by electrically operated cylinders or alternative drive devices.

The invention claimed is:

1. A vessel for towing another vessel, comprising:

a hull;

a tow cable which is coupled to the hull;

a hook having legs comprising a first leg which is fixed to a free end of said tow cable, a second leg including a free end and a hook bottom where the first leg and the second leg converge to form a V-shape at a distance from the free end of the second leg, hence forming an opening between the legs at the free end of the second leg, and wherein the first and second legs extend in a main plane;

a tow rope that is located at the vessel and launched from another vessel is received in the opening;

a hook support to which the hook is linkable;

a rope positioning system configured to position a tow rope and the hook support with respect to each other such that the tow rope extends in a transverse direction of the main plane at the opening of the hook when the hook is linked to the hook support; and a rope pressing system configured to press the tow rope positioned at the opening of the hook towards the hook bottom when the hook is linked to the hook support, hence the V-shape of the legs creating a clamping force upon the tow rope under operating conditions.

2. The vessel according to claim 1, wherein the hook support has a carrier and wherein when the hook is linked to the hook support, the hook is supported by the carrier via the first leg and moveable with respect to the hook support in a longitudinal direction of the first leg between a rope receiving position for receiving the tow rope at the opening and a rope clamping position for clamping the tow rope between the legs, wherein the rope pressing system comprises a pressing member which has a fixed position at the carrier and a moving drive configured to move the hook from the rope receiving position to the rope clamping position during which the hook bottom moves towards the pressing member.

3. The vessel according to claim 2, wherein the rope positioning system is formed by the carrier which is movable with respect to the hull in a direction parallel to the main plane and transversely to the first leg when the hook is linked to the hook support.

4. The vessel according to claim 3, wherein the pressing member is located next to the hook at said opening in the transverse direction of the main plane when the hook is linked to the hook support.

5. The vessel according to claim 4, wherein the pressing member is located at opposite sides of the hook at said opening in the transverse direction of the main plane when the hook is linked to the hook support.

6. The vessel according to claim 5, wherein the carrier has a tow rope receiving surface including a slot configured to receive at least a part of the second leg upon moving the hook from the rope receiving position to the rope clamping position, wherein the slot has edges, wherein at least one of the edges of the slot forms the pressing member, and wherein in the rope receiving position the free end of the second leg is remote from the tow rope receiving surface.

7. The vessel according to claim 6, wherein when the hook is in the rope receiving position, the free end of the second leg is directed downwardly.

8. The vessel according to claim 7, wherein the hook support is provided with a tow cable catcher configured to catch and guide the tow cable when the hook is at a distance from the hook support and drawn by the tow cable towards the hook support, which tow cable catcher is mounted to the carrier and movable with respect thereto in a same direction as the hook between a catching position in which the tow cable catcher projects from the tow rope receiving surface and a guiding position in which the tow cable catcher is located beyond the hook as seen in a direction along the first leg from the hook to the tow cable when the hook is in the rope receiving position, such that in the rope receiving position the tow cable extends successively in one direction from the first leg of the hook to the tow cable catcher and via the tow cable catcher in an opposite direction.

9. The vessel according to claim 8, wherein the tow cable catcher comprises a T-shaped element.

10. The vessel according to claim 9, wherein the hook support is provided with a tube in which a portion of the first leg fits against an abutment and in which the tow cable catcher fits, wherein the first leg and the tow cable catcher are movable with respect to the tube in a longitudinal direction thereof, wherein the tube is mounted to the carrier and movable with respect to the carrier in a direction parallel to the first leg, wherein the tube is lockable with respect to the carrier and the tow cable catcher is lockable with respect to the tube.

11. The vessel according to claim 2, wherein the hook support and the first leg are configured such that the hook has a final number of discrete positions in rotational direction about the first leg in the rope receiving position.

12. The vessel according to claim 11, wherein one of the first leg and the hook support has a protrusion and the other one of the first leg and the hook support has a guiding surface configured to guide the protrusion upon linking the first leg to the hook support.

13. The vessel according to claim 1, wherein at least one of the first leg and the second leg has a decreasing thickness in the transverse direction of the main plane as seen in a direction towards each other.

14. The vessel according to claim 1, wherein the distance between the first leg and the second leg decreases progressively in a direction from the opening to the hook bottom.

15. The vessel according to claim 1 and further comprising a towing winch, wherein the tow cable is coupled to the hull through the towing winch.

16. The vessel according to claim 15, wherein at least a portion of the tow cable is resilient.

17. The vessel according to claim 2, wherein the pressing member is located next to the hook at said opening in the transverse direction of the main plane when the hook is linked to the hook support.

18. The vessel according to claim 4, wherein the carrier has a tow rope receiving surface including a slot configured to receive at least a part of the second leg upon moving the hook from the rope receiving position to the rope clamping position, wherein the slot has edges, wherein at least one of the edges of the slot forms the pressing member, and wherein in the rope receiving position the free end of the second leg is remote from the tow rope receiving surface.

19. The vessel according to claim 6, wherein the hook support is provided with a tow cable catcher configured to catch and guide the tow cable when the hook is at a distance from the hook support and drawn by the tow cable towards the hook support, which tow cable catcher is mounted to the carrier and movable with respect thereto in a same direction as the hook between a catching position in which tow cable catcher projects from the tow rope receiving surface and a guiding position in which the tow cable catcher is located beyond the hook as seen in a direction along the first leg from the hook to the tow cable when the hook is in the rope receiving position, such that in the rope receiving position the tow cable extends successively in one direction from the first leg of the hook to the tow cable catcher and via the tow cable catcher in an opposite direction.

20. The vessel according to claim 8, wherein the hook support is provided with a tube in which a portion of the first leg fits against an abutment and in which the tow cable catcher fits, wherein the first leg and the tow cable catcher are movable with respect to the tube in a longitudinal direction thereof, wherein the tube is mounted to the carrier and movable with respect to the carrier in a direction parallel to the first leg, wherein the tube is lockable with respect to the carrier and the tow cable catcher is lockable with respect to the tube.

* * * * *